US008890415B2

(12) United States Patent
Zhang

(10) Patent No.: US 8,890,415 B2
(45) Date of Patent: Nov. 18, 2014

(54) BACKLIGHT DRIVING CIRCUIT, LCD MODULE, AND MANUFACTURING METHOD THEREOF

(75) Inventor: Xianming Zhang, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 149 days.

(21) Appl. No.: 13/574,385

(22) PCT Filed: Jun. 26, 2012

(86) PCT No.: PCT/CN2012/077496

§ 371 (c)(1),
(2), (4) Date: Jul. 20, 2012

(87) PCT Pub. No.: WO2013/189091

PCT Pub. Date: Dec. 27, 2013

(65) Prior Publication Data

US 2013/0342108 A1 Dec. 26, 2013

(30) Foreign Application Priority Data

Jun. 21, 2012 (CN) ..... 2012 1 0208018

(51) Int. Cl.
*H05B 41/00* (2006.01)
*G09G 3/36* (2006.01)

(52) U.S. Cl.
USPC ..... 315/121; 315/297; 315/307; 315/185 R; 345/98; 345/100; 345/102

(58) Field of Classification Search
USPC ..... 315/192, 121, 297, 312, 294, 185 R, 315/250, 193, 307; 345/102, 100, 98
See application file for complete search history.

(56) References Cited

U.S. PATENT DOCUMENTS 7,652,655 B2 * 1/2010 Kim ..... 345/102
7,999,484 B2 * 8/2011 Jurngwirth et al. ..... 315/247

(Continued)

FOREIGN PATENT DOCUMENTS

CN 201185500 Y 1/2009
CN 201327518 Y 10/2009

(Continued)

OTHER PUBLICATIONS

Li Jun, the International Searching Authority written comments, Apr. 2013, CN.

(Continued)

*Primary Examiner* — Vibol Tan
(74) *Attorney, Agent, or Firm* — IPro, Inc.; Na Xu

(57) ABSTRACT

The invention provides a backlight driving circuit, an LCD device, and a manufacturing method thereof. The backlight driving circuit includes at least two LED lightbars arranged in parallel connection, the output end of each of the LED lightbars is coupled with a variable current circuit, and the variable current circuit is provided with adjustable variable resistors used for balancing the voltage difference between the LED lightbars. In the invention, because the adjustable variable resistors are arranged in the variable current circuit which is connected in series with the LED lightbars, the resistance of the adjustable variable resistors can be adjusted according to the resistance of different LED lightbars before being used; thus, the total voltage of each LED lightbar and the variable resistor connected with ed LED lightbars in series can keep consistent. Therefore, the voltages of all the pins of the control IC coupled into the driver converter can be consistent, and no additional current can be generated in the control IC because no voltage differences exist between pins basically; thus, the power consumption of the control IC is reduced, and the heat productivity of the control IC is reduced, thereby reducing the temperature of the control IC.

8 Claims, 2 Drawing Sheets

(56) References Cited

U.S. PATENT DOCUMENTS

| | | | | |
|---|---|---|---|---|
| 8,149,191 | B2 * | 4/2012 | Kunst et al. | 345/82 |
| 8,421,374 | B2 * | 4/2013 | Lin et al. | 315/297 |
| 2010/0283773 | A1 * | 11/2010 | Kim | 345/211 |
| 2010/0301762 | A1 | 12/2010 | Kung et al. | |
| 2011/0175550 | A1 * | 7/2011 | Lin et al. | 315/297 |

FOREIGN PATENT DOCUMENTS

| | | | |
|---|---|---|---|
| CN | 201403234 | Y | 2/2010 |
| CN | 201946274 | U | 8/2011 |
| CN | 102280089 | A | 12/2011 |
| JP | 201045223 | A | 2/2010 |
| KR | 1020080079046 | A | 8/2008 |

OTHER PUBLICATIONS

Jiang Yongzhi, the first office action, Jun. 2013, CN.

* cited by examiner

BACKLIGHT DRIVING CIRCUIT, LCD MODULE, AND MANUFACTURING METHOD THEREOF

TECHNICAL FIELD

The invention relates to field of liquid crystal displays (LCDs), and more particularly to a backlight driving circuit, an LCD module, and a manufacturing method thereof.

BACKGROUND

LCD devices include LCD panels, and backlight modules. In a backlight module using LED(s), if a plurality of LED lightbars are used, as shown in FIG. 1 and FIG. 2, the LED lightbars are arranged in parallel connection, each LED lightbar is in series connection to the same converter, a control integrated circuit (IC) is arranged in the converter, and the control IC is coupled with the output end of each LED lightbar. Because the voltages of all the LED lightbars are different, namely $V_{F1}$, $V_{F2}$, $V_{F3}$ and $V_{F4}$ are unequal, and the voltages of the branch voltages $V_{LED}$ of the whole LED lightbar are equal, the inequality of $V_{F1}$, $V_{F2}$, $V_{F3}$ and $V_{F4}$ results in different voltages of $V_{LED1}$, $V_{LED2}$, $V_{LED3}$ and $V_{LED4}$ applied onto the control IC of the converter. Current is generated when voltage differences exist, thereby increasing the temperature of the control IC used in the backlight drive converter. To solve the temperature problem, a thermal pad or bare copper is required to be added, thereby increasing the cost.

SUMMARY

In view of the above-described problems, the aim of the invention is to provide a low-cost backlight driving circuit, an LCD module, and a manufacturing method thereof capable of reducing the temperature of the control IC in a backlight drive converter.

The aim of the invention is achieved by the following technical scheme.

A backlight driving circuit comprises at least two LED lightbars arranged in parallel connection, the output end of each of the LED lightbars is coupled with a variable current circuit, and the variable current circuit is provided with adjustable variable resistors used for balancing the voltage difference between the LED lightbars.

Preferably, the variable current circuit comprises a control IC; one end of each variable resistor is coupled to the output end of one LED lightbar in series connection, and the other end is coupled to the control IC in series connection. This is a specific circuit structure of the variable current circuit.

Preferably, the variable current circuit further comprises an isolating switch; the variable resistors are coupled to the control IC in series connection by the isolating switch. By adding the isolating switch, when the LED lightbar(s) is short-circuited, the isolating switch is disconnected, thereby preventing all the branch voltages from being applied onto the control IC and then damaging the control IC.

Preferably, the variable current circuit further comprises a connector. The variable resistors are coupled to the output end of the LED lightbar in series connection by the connector. The connector facilitates the overhaul of the variable current circuit. During overhaul, the variable current circuit can be individually separated from the driving circuit by disconnecting the connector.

Preferably, except the LED lightbar with the maximum difference voltage, all the rest LED lightbars are in series connection with the variable resistors. By taking the voltage of the LED lightbar with maximum voltage difference as a reference voltage, on the one hand, the resistor of one LED lightbar is saved; on the other hand, because the reference voltage is low, the rest LED lightbars are in series connection with resistors with low resistance. Thus, the consumption of the electric energy on the resistors is reduced, thereby favoring the reduction of energy consumption.

An LCD device comprises the backlight driving circuit mentioned above.

A manufacturing method of the backlight driving circuit comprises a step A: connecting a variable current circuit to the output end of each LED lightbar in series, and arranging adjustable variable resistors used for balancing the voltage difference between the LED lightbars in the variable current circuit.

Preferably, the step A comprises:

A1: Calculating the voltage difference of the two ends of each LED lightbar, and taking the maximum voltage difference as a reference voltage;

A2: Except the LED lightbar(s) which is consistent with the reference voltage, all the branches of the rest LED lightbars are in series connection with variable resistors, the resistance of each variable resistor is regulated by a mechanical mode; thus, the sum of the total voltage differences of the LED lightbars and the variable resistors is equal to the reference voltage.

By taking the voltage of the LED lightbar with maximum voltage difference as a reference voltage, on the one hand, the resistor of one LED lightbar is saved; on the other hand, because the reference voltage is low, the rest LED lightbars are in series connection with resistors with low resistance. Thus, the consumption of the electric energy on the resistors is reduced, thereby favoring the reduction of energy consumption.

Preferably, in the step A, the variable current circuit comprises a control IC; one end of each variable resistor is coupled to the output end of one LED lightbar in series connection, and the other end is coupled to the control IC in series connection. This is a specific circuit structure of the variable current circuit.

Preferably, in the step A, the variable current circuit further comprises an isolating switch, and a connector; one end of the variable resistor is coupled to the control IC in series connection by the isolating switch; the other end is coupled to the output end of the LED lightbar in series connection by the connector. By adding the isolating switch, when the LED lightbar(s) is short-circuited, the isolating switch is disconnected, thereby preventing all the branch voltages from being applied onto the control IC and then damaging the control IC. The connector facilitates the overhaul of the variable current circuit. During overhaul, the variable current circuit can be individually separated from the driving circuit by disconnecting the connector.

In the invention, because the adjustable variable resistors are arranged in the variable current circuit which is connected with the LED lightbars in series connection, the resistance of the adjustable variable resistors can be adjusted according to the resistance of different LED lightbars before being used; thus, the total voltage of each LED lightbar and the variable resistor connected with the variable resistor in series can keep consistent. Therefore, the voltages of all the pins of the control IC coupled into the drive converter can be consistent, and no additional current can be generated in the control IC because no voltage differences exist between pins basically; thus, the power consumption of the control IC is reduced, and the heat productivity of the control IC is reduced, thereby reducing the temperature of the control IC.

DETAILED DESCRIPTION

An LCD device comprises a backlight module. The backlight module is provided with a backlight driving circuit. The backlight driving circuit comprises at least two LED lightbars arranged in parallel connection, the output end of each of the LED lightbars is coupled with a variable current circuit, and the variable current circuit is provided with adjustable variable resistors used for balancing the voltage difference between the LED lightbars.

In the invention, because the adjustable variable resistors are arranged in the variable current circuit which is in series connection with the LED lightbars, the resistance of the adjustable variable resistors can be adjusted according to the resistance of different LED lightbars before being used; thus, the total voltage of each LED lightbar and the variable resistor connected with the LED lightbar in series can keep consistent. Therefore, the voltages of all the pins of the control IC coupled into the drive converter can be consistent, and no additional current can be generated in control IC because no voltage differences exist between pins basically; thus, the power consumption of the control IC is reduced, and the heat productivity of the control IC is reduced, thereby reducing the temperature of the control IC. The backlight driving circuit of the invention will be further described in accordance with the Figures and preferred examples.

Figure 1:
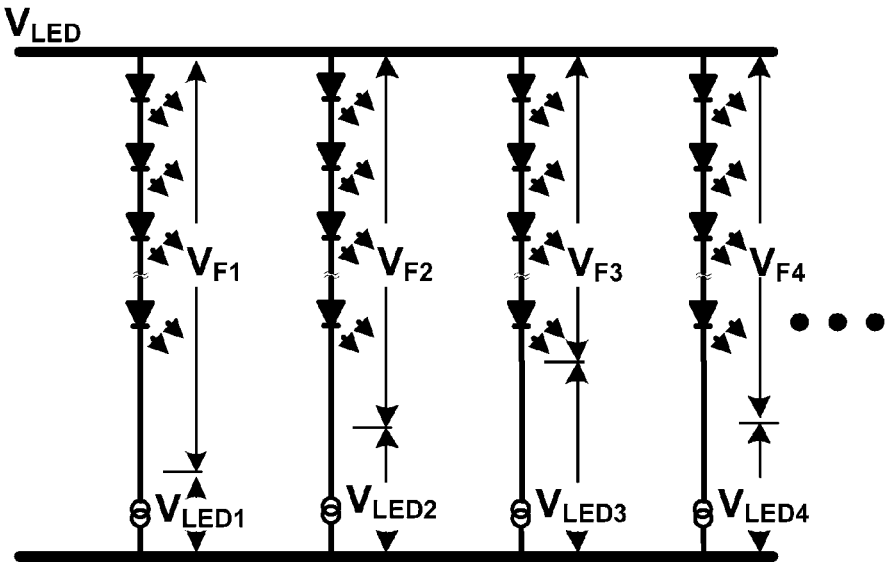
Figure 1 (Prior Art)
FIG. 1 is a schematic diagram of a conventional backlight driving circuit.
Figure 2:
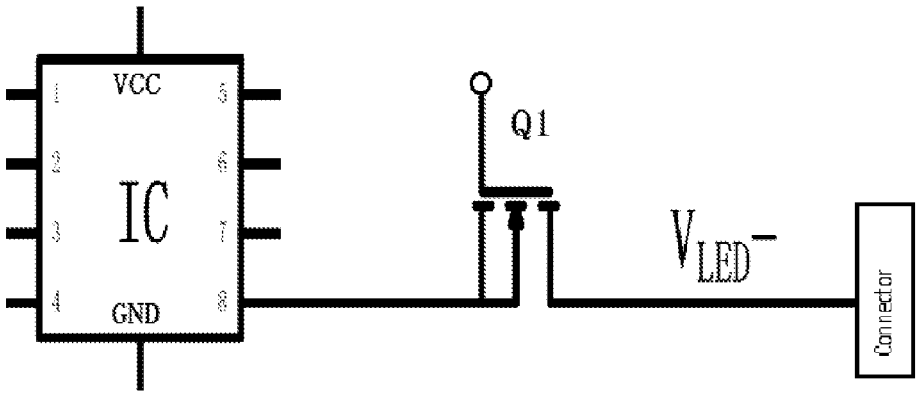
Figure 2 (Prior Art)
FIG. 2 is a schematic diagram of a backlight driving circuit with an isolating switch.
Figure 3:
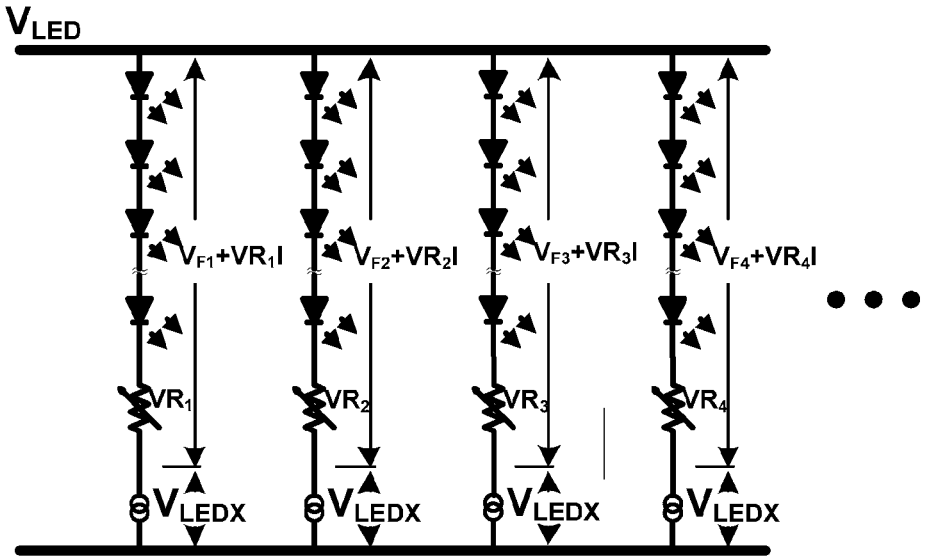
FIG. 3 is a schematic diagram of a backlight driving circuit of an example of the invention.

As shown in FIG. 3, there are four LED lightbars in the Figure. Each variable resistor of the variable current circuit is connected with one LED lightbar, $VR_1$-$VR_4$ respectively. Thus, the resistance of the branch of each LED lightbar is adjustable. Furthermore, except the LED lightbar with maximum voltage difference, the rest LED lightbars are in series connection with adjustable variable resistors. By taking the voltage of the LED lightbar with maximum voltage difference as a reference voltage, on the one hand, the resistor of one LED lightbar is saved; on the other hand, because the reference voltage is low, the rest LED lightbars are in series connection with resistors with low resistance. Thus, the consumption of the electric energy on the resistors is reduced, thereby favoring the reduction of energy consumption.

Figure 4:
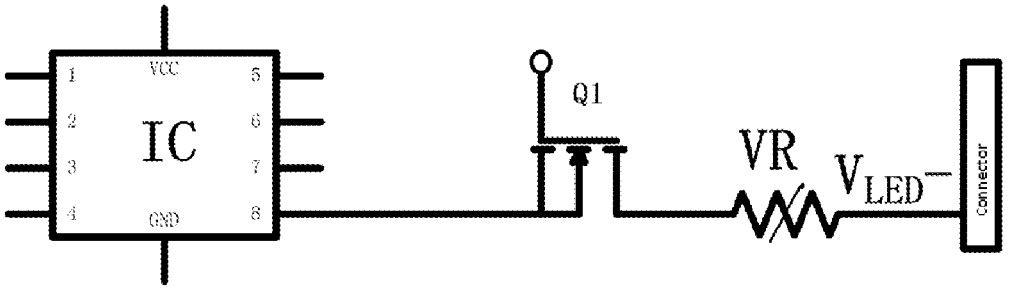
FIG. 4 is a schematic diagram of a backlight driving circuit with an isolating switch of an example of the invention.

Furthermore, as shown in FIG. 4, the variable current circuit further comprises an isolating switch Q1, and a connector; one end of the variable resistor VR is coupled to the control IC in series connection by the isolating switch Q1, and the other end is coupled to the output end of the LED lightbar in series connection by the connector. By adding the isolating switch, when the LED lightbar(s) is short-circuited, the isolating switch is disconnected, thereby preventing all the branch voltages from being applied onto the control IC and then damaging the control IC. The connector facilitates the overhaul of the variable current circuit. During overhaul, the variable current circuit can be individually separated from the driving circuit by disconnecting the connector.

The invention further provides a manufacturing method of the backlight driving circuit. We can measure the voltages $V_{F1}$, $V_{F2}$, $V_{F3}$, $V_{F4}$ . . . of all the LED lightbars under the required current I after manufacturing each LED lightbar. Thus, the LED lightbar with maximum voltage is measured, and the voltage thereof is set to be $V_{FX}$. Then, we can connect each of the rest LED lightbars with a variable resistor in series connection, and adjust the resistance of the variable resistors by a mechanical mode. Thus, $V_{F1}+VR_1=V_{F2}+VR_2=V_{F3}+VR_3=V_{F4}+VR_4=\ldots=V_{FX}$. Under the condition that the total voltage $V_{LED}$ is constant, the total voltage of each LED lightbars and the digital resistor keeps consistent, and then the voltage difference between the pins of the control IC of the variable current circuit is low, namely $v_{LEDX}$ keeps consistent and approaches most closely to the required voltage of the control IC, thereby reducing the heat productivity of the control IC.

The invention is described in detail in accordance with the above contents with the specific preferred examples. However, this invention is not limited to the specific examples. For the ordinary technical personnel of the technical field of the invention, on the premise of keeping the conception of the invention, the technical personnel can also make simple deductions or replacements, and all of which should be considered to belong to the protection scope of the invention.

I claim:

1. A backlight driving circuit, comprising: at least two LED lightbars arranged in parallel connection; the output end of each said LED lightbar is coupled with a variable current circuit, and said variable current circuit comprises adjustable resistors and a control IC, wherein the adjustable variable resistors used for balancing the voltage difference between said at least two LED lightbars, and one end of each said variable resistor is coupled to the output end of one LED lightbar in series connection, and the other end is coupled to said control IC in series connection; and wherein said variable current circuit further comprises an isolating switch; said variable resistor is coupled to said control IC in series connection by said isolating switch.

2. The backlight driving circuit of claim 1, wherein said variable current circuit further comprises a connector; said variable resistor is coupled to the output end of said LED lightbar in series connection by said connector.

3. The backlight driving circuit of claim 1, wherein except the LED lightbar with maximum difference voltage, the rest LED lightbars are in series connection with said variable resistors.

4. An LCD device, comprising: a backlight driving circuit; wherein said backlight driving circuit comprises at least two LED lightbars arranged in parallel connection, the output end of each said LED lightbar is coupled with a variable current circuit, and said variable current circuit comprises adjustable resistors and a control IC, wherein the adjustable variable resistors used for balancing the voltage difference between said at least two LED lightbars, and one end of each said variable resistor is coupled to the output end of one LED lightbar in series connection, and the other end is coupled to said control IC in series connection; and wherein said variable current circuit further comprises an isolating switch; said variable resistor is coupled to said control IC in series connection by said isolating switch.

5. The LCD device of claim 4, wherein said variable current circuit further comprises a connector; said variable resistor is coupled to the output end of said LED lightbar in series connection by said connector.

6. The LCD device of claim 4, wherein except the LED lightbar with maximum difference voltage, the rest LED lightbars are in series connection with said variable resistors.

7. A manufacturing method of a backlight driving circuit comprising at least two LED lightbars, the manufacturing method comprising: a step A: connecting a variable current circuit to an output end of each said LED lightbar in series connection, and arranging adjustable variable resistors used for balancing the voltage difference between said LED lightbars in a variable current circuit comprising a control IC; one end of each variable resistor is coupled to the output end of one LED lightbar in series connection, and the other end is coupled to said control IC in series connection; and wherein said variable current circuit further comprises an isolating switch; said variable resistor is coupled to said control IC in series connection by said isolating switch.

8. The manufacturing method of the backlight driving circuit of claim 7, wherein said step A comprises:

A1: Calculating the voltage difference of the two ends of each LED lightbar, and taking the maximum voltage difference as a reference voltage;

A2: Except the LED lightbar which is consistent with the reference voltage, all the branches of the rest LED lightbars are in series connection with variable resistors, the resistance of each variable resistor is adjusted by a mechanical mode; thus, the sum of the total voltage differences of said LED lightbars and said variable resistors is equal to said reference voltage.

* * * * *